US005246380A

United States Patent [19]

Kodama

[11] Patent Number: 5,246,380

[45] Date of Patent: Sep. 21, 1993

[54] CONNECTOR

[75] Inventor: Shinji Kodama, Shizuoka, Japan

[73] Assignee: Yazaki Corporation, Japan

[21] Appl. No.: 879,355

[22] Filed: May 7, 1992

[30] Foreign Application Priority Data

Jun. 26, 1991 [JP] Japan ..... 3-048547[U]

[51] Int. Cl.[5] ..... H01R 13/627

[52] U.S. Cl. ..... 439/354; 439/358; 285/921; 24/616

[58] Field of Search ..... 439/350–358; 285/921, 319; 403/326, 321, 319; 24/575, 615, 616

[56] References Cited

U.S. PATENT DOCUMENTS 3,409,858 11/1968 Krehbiel ..... 439/354
4,884,978 12/1989 Inaba et al. ..... 439/350
4,946,404 8/1990 Takenouchi et al. ..... 439/352

FOREIGN PATENT DOCUMENTS 62-25480 2/1987 Japan .
62-25580 2/1987 Japan .
0117281 5/1989 Japan ..... 439/354

*Primary Examiner*—Larry I. Schwartz
*Assistant Examiner*—Hien D. Vu
*Attorney, Agent, or Firm*—Wigman, Cohen, Leitner & Myers

[57] ABSTRACT

A connector comprising a female-type connector and a male-type connector which is inserted into and fitted in said female-type connector is disclosed. The connector includes a flexible locking arm provided on said male-type connector, a locking portion provided on the flexible locking arm, a lock-engaging portion formed in the female-type connector so as to be engaged with the locking portion, and a holding means for maintaining a state in which the locking arm is bent when in a lock-disengaging state in which the locking portion is disengaged from the lock-engaging portion.

5 Claims, 6 Drawing Sheets

CONNECTOR

BACKGROUND OF THE INVENTION

1. Field of the Invention

The present invention relates to a connector comprised of a male-type connector and a female-type connector. In particular, the invention is directed to a connector provided with both a locking portion formed on a flexible locking arm on the male-type connector and with a lock-engaging portion formed on the female-type connector. In this way, the male-type connector may be coupled with the female-type connector in a state in which the locking portion is engaged with the lock-engaging portion.

2. Description of the Prior Art

A kind of connector has been disclosed in Japanese Utility Model Application No. 62-25480 as shown in FIGS. 1 and 2. This kind of connector comprises a male-type connector 3 and a female-type connector 7 provided with a fitting hood part 5 into which the male-type connector is to be inserted and fitted.

A connector body 9 of the male-type connector 3 is provided with a plurality of terminal accommodating chambers 11 into which a plurality of female-type terminal elements (which are not shown in FIGS. 1, 2) caulked and connected with ends of wires 19 can be accommodated, respectively. The connector body 9 is provided with a flexible locking arm 13 molded in one piece therewith. The flexible locking arm 13 has a free end provided with presser portions 15 and a locking portion 17 located in the middle thereof.

The housing part 23 of the female-type connector 7 is provided with a plurality of terminal accommodating chambers 21 into which a plurality of male-type terminal elements (which are not shown in FIGS. 1, 2) caulked and connected with ends of wires 19 can be accommodated, respectively. The fitting hood part 5 is provided with a lock-engaging portion 25 on a upper wall thereof.

After a coupling face 3*a* of the male-type connector 3 is placed facing the coupling hood part 5 of the female-type connector 7, the male-type connector 3 is inserted into the coupling hood part 5 so that the male-type connector 3 is inserted into and coupled with the female-type connector 7. While the male-type connector 3 is inserted into the coupling hood part 5, the open end of the coupling hood part 5 is abutted against the flexible locking arm 13. While in this situation, the male-type connector 3 is further inserted into the fitting hood part 5, thereby causing the flexible locking arm 13 to become bent. If the male-type connector 3 is completely inserted into the fitting hood part 5, the locking portion 17 protruding from the flexible locking arm 13 becomes engaged with the lock-engaging portion 25 while the flexible locking arm 13 returns to its former position thereof.

In this manner, a complete fitting state of the male-type connector 3 into the female-type connector 7 is accomplished as shown in FIG. 2. This complete fitting state can be maintained by engaging the locking portion 17 with the lock-engaging portion 25. In this state, the male-type terminal elements accommodated in the terminal accommodating chambers 21 of the female-type connector 7 are inserted into and fitted in the female-type terminal elements accommodated in the terminal accommodating chambers 11 of the male-type connector 3, followed by an electrical connection therewith.

In order to separate the engaged female-type connector 7 and the male-type connector 3, the presser portions 15 located on the end portion of the flexible locking arm 13 can be pressed by a finger, such as the first finger of the right hand, so that the flexible locking arm 13 is bent thereby disengaging the locking portion 17 from the lock-engaging portion 25. While the flexible locking arm 13 is being bent by using, for example, the right hand, the male-type connector 3 can be pulled out of the fitting hood part 5. Thus, the male-type connector 3 is separated from the female-type connector 7.

As according to the prior art, the above-described connector 1, it is necessary for the flexible locking arm 13 to be continually pressed while the male-type connector 3 is pulled so that the locking portion 17 can be disengaged from the lock-engaging portion 25 while the male-type connector 3 is pulled out of the fitting hood part 5 of the female-type connector 7. As a consequence, it is troublesome to disengage the male-type connector 3 from the female-type connector 7.

SUMMARY OF THE INVENTION

In view of the above, an object of the present invention is to solve the aforementioned problems in the prior art through the introduction of a connector by which a male-type connector can be pulled out of a female-type connector very easily.

The aforesaid object of the present invention is accomplished through a connector comprising:

- a female-type connector;
- a male-type connector being inserted into and fitted in said female-type connector;
- a flexible locking arm provided on said male-type connector;
- a locking portion provided on the flexible locking arm;
- a lock-engaging portion formed in the female-type connector so as to be engaged with the locking portion; and
- a holding means for holding a state in which the locking arm is bent so that the locking portion is disengaged from the lock-engaging portion.

In a preferred embodiment, said holding means comprises a first engaging projection provided on the female-type connector and a second engaging projection provided on the flexible locking arm of the male-type connector so that the second engaging projection is engaged with the first engaging projection.

In order to separate the male-type connector from the female-type connector according to the present invention, the flexible locking arm is pressed and bent to a state in which the locking portion is disengaged from the lock-engaging portion. Then the lock-disengaging state is maintained by the holding means. In this condition, the male-type connector is pulled out and separated from the female-type connector.

In this manner, once the flexible locking arm is pressed and bent so as to disengage the locking portion from the lock-engaging portion, no further pressing is necessary with respect to the flexible locking arm. Thus, the male-type connector can be separated from the female-type connector, simply by pulling the male-type connector out of the female-type connector.

That is, when the flexible locking arm is bent up to the lock-disengaging state in which the locking portion is disengaged from the lock-engaging portion, the first engaging projection provided on the female-type connector is engaged with the second engaging projection provided on the flexible locking arm so that the state in which the flexible locking arm is bent can be maintained. Therefore, in this situation, the male-type connector can be easily pulled out of the female-type connector.

BRIEF DESCRIPTION OF THE DRAWINGS

Referring to the drawings, wherein like reference characters refer to like parts through FIGS. 3~11, and wherein:

FIG. 4 (*b*) is a fragmentary enlarged perspective view showing the first engaging projection and the second engaging projection illustrated in FIG. 4 (*a*) under a condition that the second engaging projection is engaged with the first engaging projection;

DETAILED DESCRIPTION OF THE PREFERRED EMBODIMENTS

Figure 1:
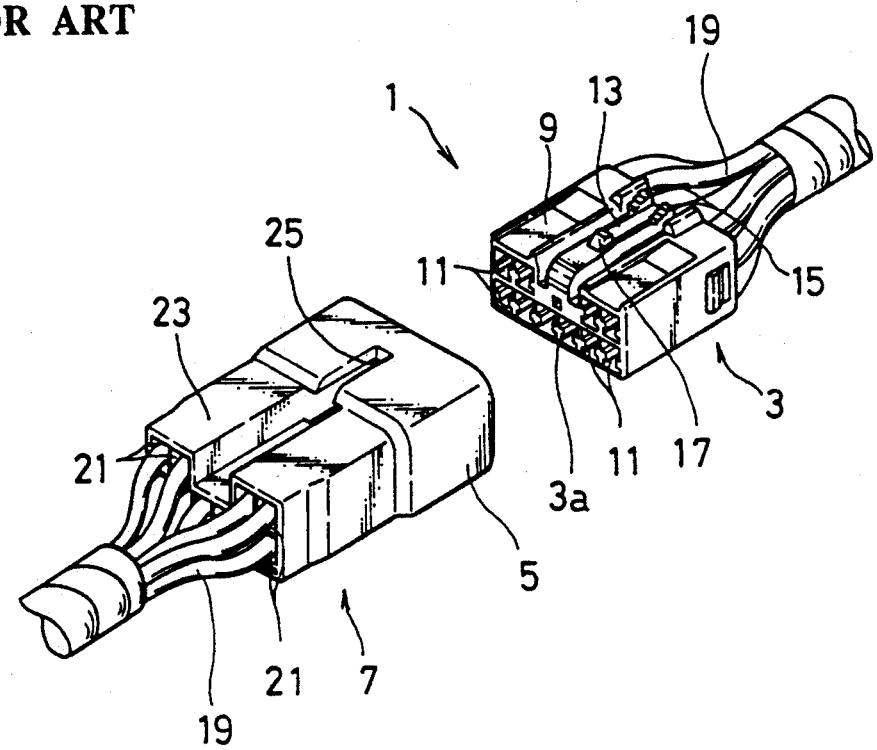
FIG.1 PRIOR ART
FIG. 1 is a perspective view of a connector consisting of a male-type connector and a female-type connector, according to a conventional example.
Figure 2:
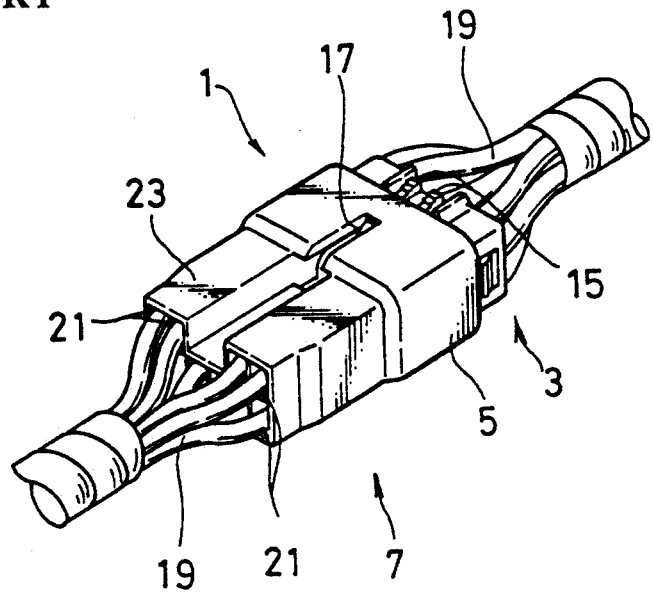
FIG.2 PRIOR ART
FIG. 2 is a perspective view of the connector illustrated in FIG. 1 and a coupling-state explanation view thereof.

An embodiment of the present invention will be described hereinafter using FIGS. 3~11.

A connector 31 according to the preferred embodiment consists of a male-type connector 33 and a female-type connector 37 provided with a fitting hood part 35 into which the male-type connector 33 is inserted in order to be fitted therein. The connector 31 comprises a holding means 63 which will be described below.

A connector body 39 of the male-type connector 33 is provided with a plurality of terminal accommodating chambers 41 in which female-type terminal elements (which are not shown in any FIGS.) caulked and connected with ends of wires (which are omitted in the FIGS.) are accommodated. Further, the connector body 39 comprises a flexible locking arm 43 in a unitary structure therewith. A free end of the flexible locking arm 43 is provided with a presser portion 45 which, when pressed in a direction against the connector body 39 by a finger such as the first finger is bent in that same direction. A locking portion 47 protrudes from the middle position of the flexible locking arm 43.

Figure 3:
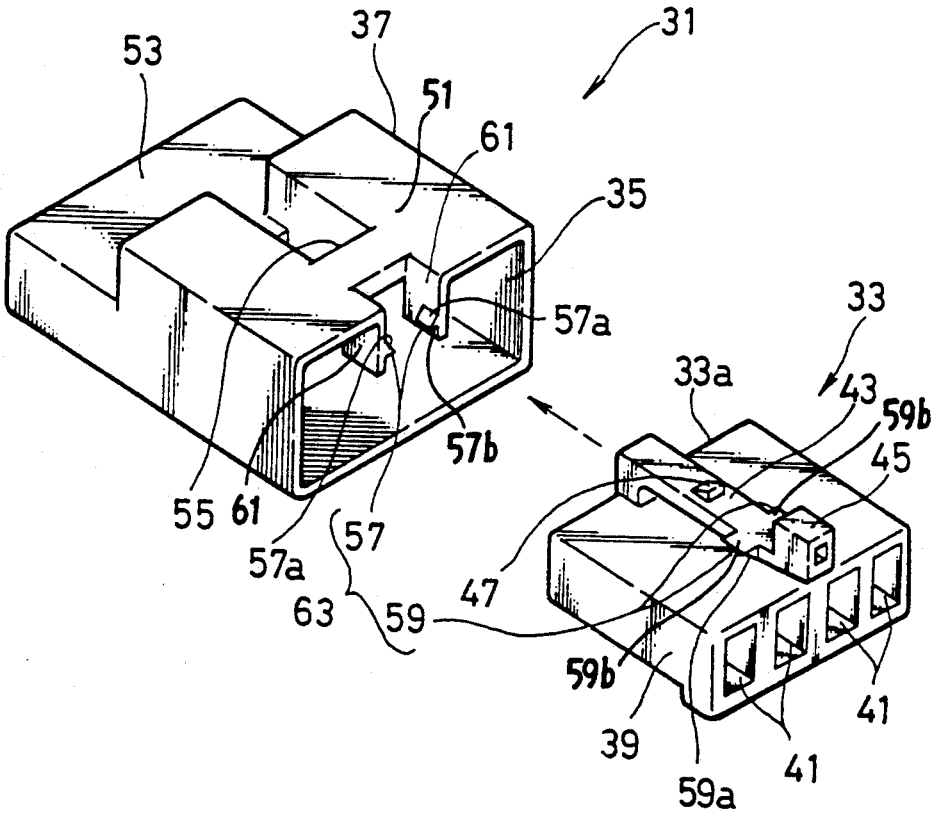
FIG. 3 is a perspective view of a connector according to an embodiment of the present invention.
Figure 4:
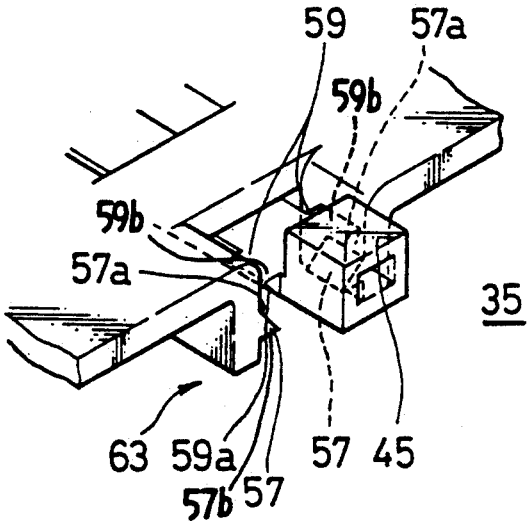
FIG. 4 (*a*) is a fragmentary enlarged perspective view showing a first engaging projection and a second engaging projection.
Figure 4:
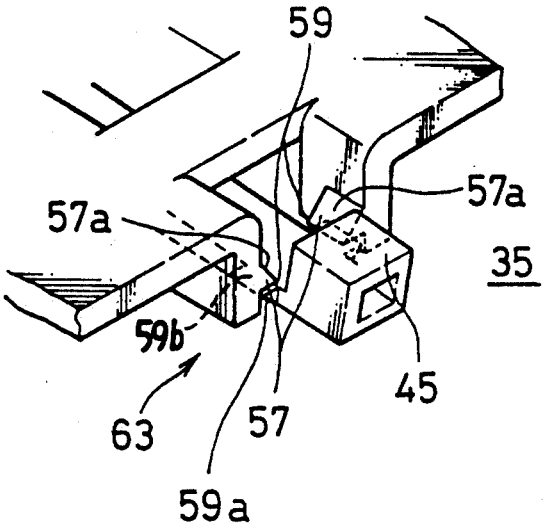

A pair of second engaging projections 59 are formed between the presser portion 45 and locking portion 47 on the flexible locking arm 43, protruding from positions located on the both side-walls of the flexible locking arm 43. The pair of second engaging projections 59 have a pair of right-triangle-like cross-sections so as to have a pair of second faces 59*a* sloping downwards, i.e. toward the connector body 39, and first faces 59*b* extending in a direction in which a top face of the flexible locking arm 43 extends, as shown in FIG. 3 and FIG. 4 (*a*), (*b*). Namely, the pair of slopes 59*a* of the second engaging projections 59 slope in the direction in which the flexible locking arm 47 is to be bent.

A plurality of terminal accommodating chambers are arranged in a housing part 53 of the female-type connector 37, wherein male-type terminal elements (which are not shown in any Figs.) caulked and connected with ends of wires (which are omitted in the Figs.) are accommodated. Further, a lock-engaging portion 55 includes a side wall 51 the fitting hood part 35 of the female-type connector 37. Moreover, the fitting hood part 35 is provided with a pair of flexible engaging walls 61 which extend from the top wall 51 at approximately right angles towards the inside of the fitting hood part 35. Consequently, the second engaging projections 59 confront the engaging walls 61 when the male-type connector 33 is fitted in the fitting hood part 35 of the female-type connector 37. A pair of first engaging projections 57 are provided on each end of the engaging walls 61 so as to face one another therefrom. Each of the pair of first engaging projections 57 has a right-triangle-like cross-section so as to have a pair of first faces 57*b* extending at approximately right angles to the engaging walls 61 and a pair of second faces 57*a* which slope upwards as shown in FIGS. 3, 4 respectively. Namely, each slope 57*a* of the engaging projections 57 slopes in the direction in which the flexible locking arm 43 is bent.

These first engaging projections 57 and second engaging projections 59 are essential members of the holding means 63.

Next, using FIGS. 5~11, a method of fitting by which the male-type connector 33 is inserted into and fitted in the fitting hood part 35 of the female-type connector 37 will be described below along with a method of separation by which the male-type connector 33 is pulled out of the fitting hood 35 so as to be separated from the female-type connector 37.

Figure 5:
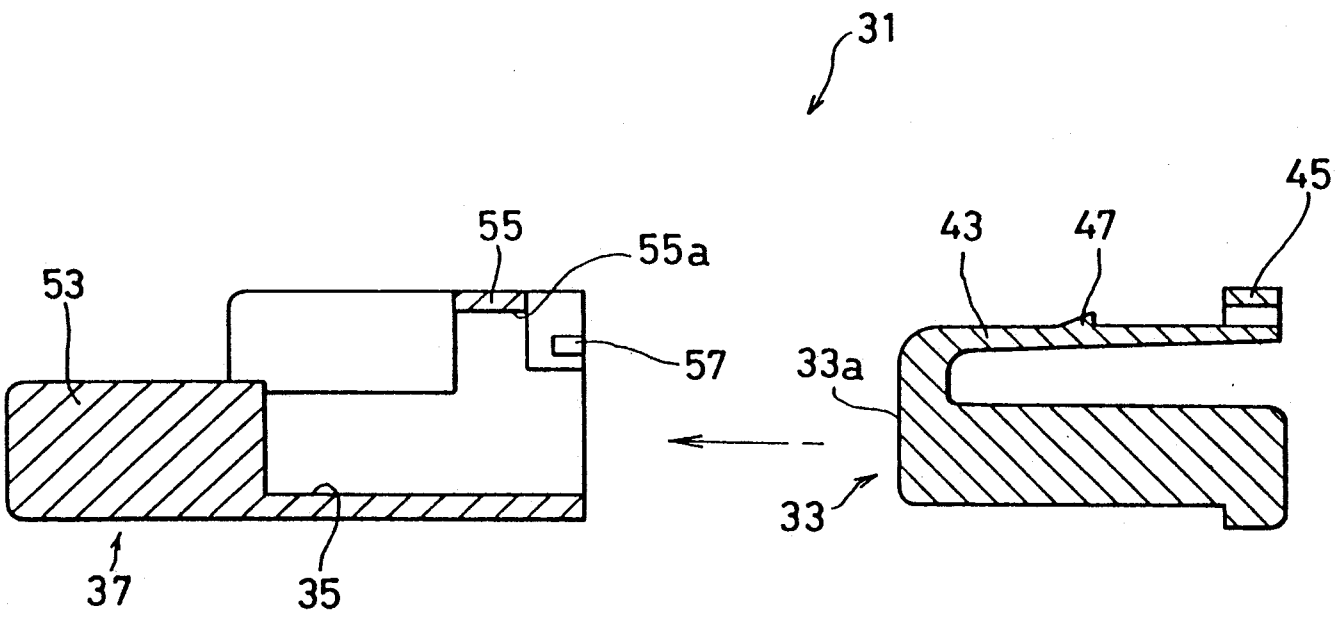
FIG. 5 is a cross-sectional view of the connector illustrated in FIG. 3.
Figure 6:
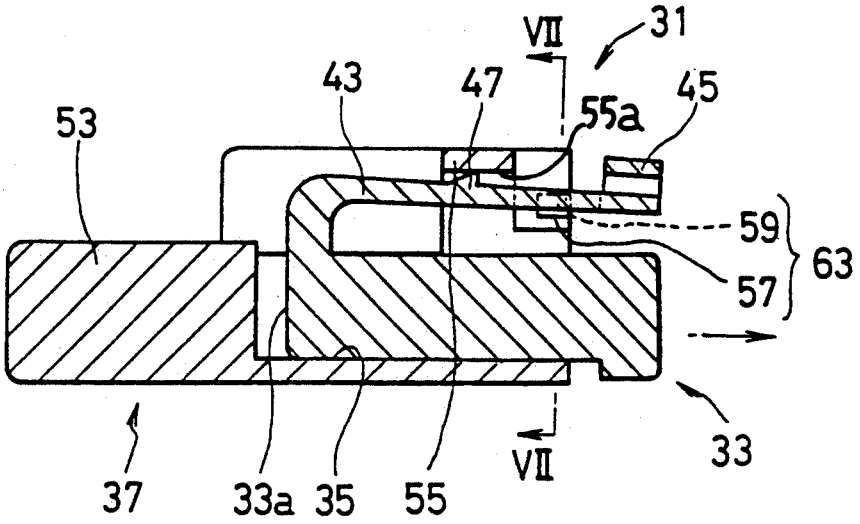
FIG. 6 is a cross-sectional view of the connector showing a state in which the male-type connector is halfway inserted into the female-type connector.
Figure 7:
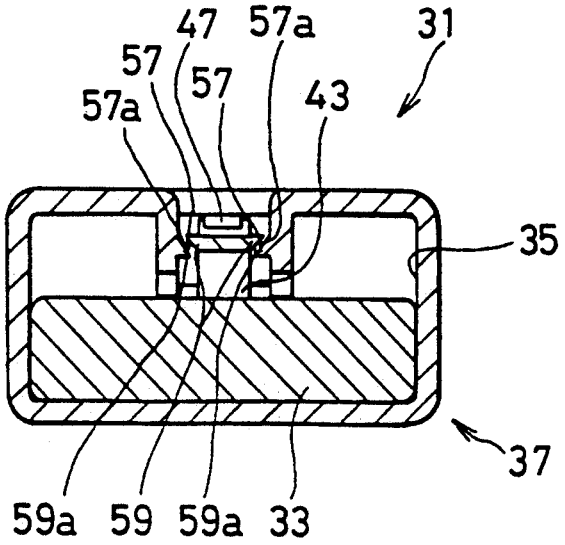
FIG. 7 is a cross-sectional view taken substantially along the lines VII—VII of FIG. 6.

First, a fitting face 33*a* of the male-type connector 33 is placed suitably facing the open end of the fitting hood part 35 of the female-type connector 37 as shown in FIG. 5. The male-type connector 33 is then inserted into the female-type connector 37. By this operation, the locking portion 47 of the flexible locking arm 43 is abutted against an open edge 55*a* of the fitting hood part 35. While the male-type connector 33 is further inserted into the inner part of the fitting hood part 35, the flexible locking arm 43 is bent as shown in FIG. 6. In this situation, the second engaging projections 59 pass through the open end of the female-type connector 37 beyond the upper side of the first engaging projection 57.

Figure 8:
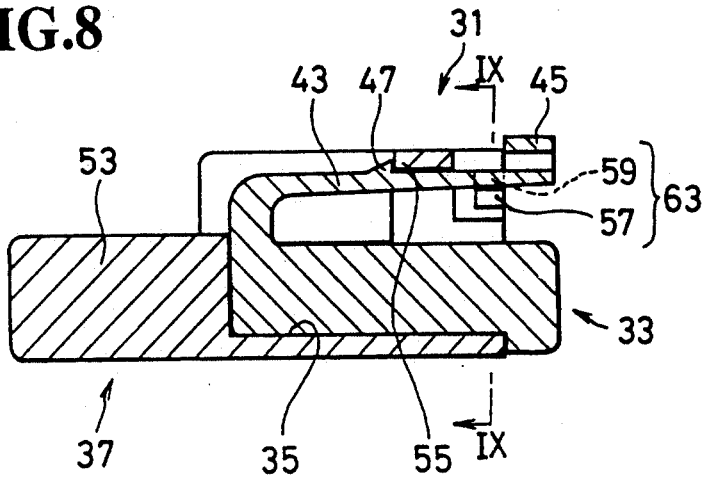
FIG. 8 is a cross-sectional view of the connector showing a state in which the male-type connector is completely inserted into and fitted in the female-type connector.
Figure 9:
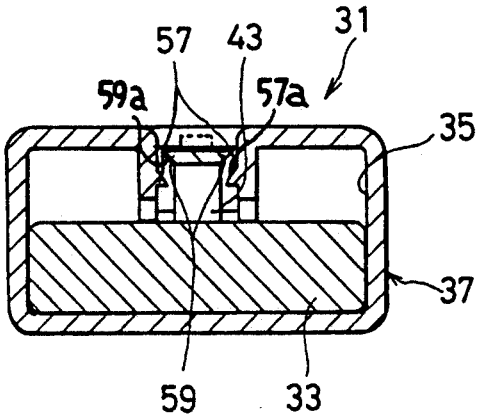
FIG. 9 is a cross-sectional view taken substantially along the lines IX—IX of FIG. 8.

When the male-type connector 33 is completely inserted into the fitting hood part 35, the locking portion 47 engages with the lock-engaging portion 55 as shown in FIGS. 8, 9. In this state, the locking portion 47 is no longer pressed by the open edge 55*a* of the lock-engaging portion 55 and the flexible locking arm 43 is released from its bent state. In this situation, the second engaging projections 59 are located above the first engaging projections 57.

In the above-described situation, the male-type connector 33 is fitted in the female-type connector 37, which is maintained due to the engagement of locking portion 47 and the lock-engaging portion 55. Further, male-type terminal elements accommodated inside the terminal accommodating chambers of the female-type connector 37 are inserted into the female-type terminal elements accommodated inside the terminal accommodating chambers of the male-type connector 33 so that both terminal elements can be electrically connected.

Figure 10:
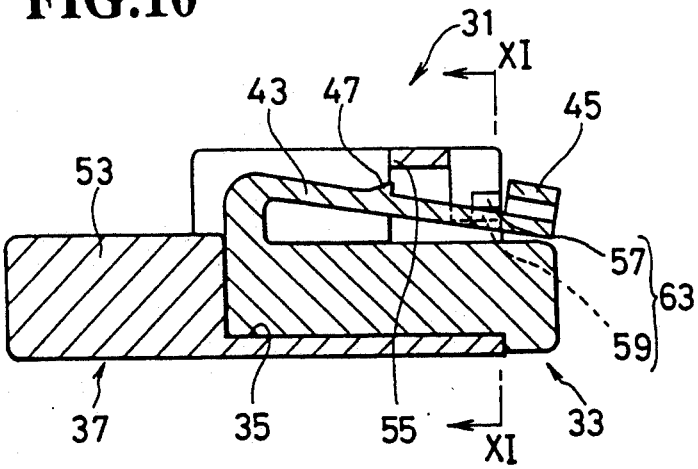
FIG. 10 is a cross-sectional view of the connector showing a state in which a flexible locking portion is bent and located in the position which creates a lock-disengaging state.
Figure 11:
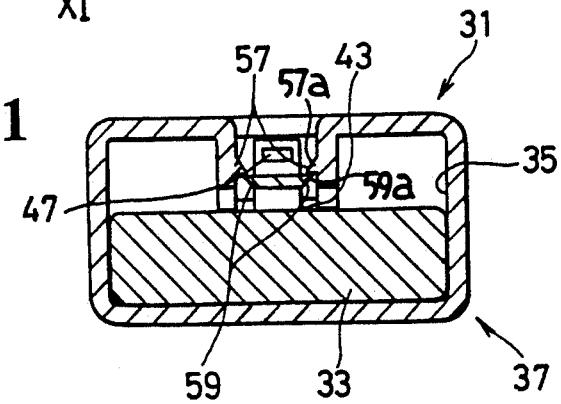
FIG. 11 is a cross-sectional view taken substantially along the lines XI—XI of FIG. 10.

Next, in order to pull the male-type connector 33 out of the female-type connector 37, the presser portion 45 located on the free end of the flexible locking arm 43 is pushed downwards and bent until the second engaging projections 59 are located below the first engaging projections 57 as shown in FIGS. 10, 11. Thus the locking portion 47 is disengaged from the lock-engaging portion 55, and the second engaging projections 59 are engaged with first engaging projections 57. Namely, a lock-disengaging state in which the locking portion 47 is disengaged from the lock-engaging portion 55 is accomplished and maintained. In other words, the holding means 63 comprising the first engaging projections 57 and the second engaging projections 59 maintains a lock-disengaging position of the flexible locking arm 43 wherein the locking portion 47 is disengaged from the lock-engaging portion 55. In the above-described operations, the second engaging projections 59 can pass downwards through the first engaging projections 57 very easily due to the second faces 57*a* and 59*a*.

Thus the separation of the male-type connector 33 from the fitting hood part 35 of the female-type connector 37, as shown in FIG. 5, may be easily accomplished by pulling the male-type connector 33 out of the fitting hood part 35 when in the lock-disengaging state in which the flexible locking arm 43 is maintained in a bent position.

As described above, the flexible locking arm 43 is maintained in a downwardly bent position by the holding means 63 in the lock-disengaging state. Namely, the flexible locking arm 43 is in the lock-disengaging position in which the lock portion 47 is disengaged from the lock-engaging portion 55. Accordingly, in this state, the male-type connector 33 can be separated easily from the female-type connector 37 by pulling the male-type connector 33 out of the fitting hood part 35 of the female-type connector 37.

In the above embodiment, the second engaging projections 59 can easily pass downwards through the first engaging projections 57 due to the flexibility of the engaging walls 61. Alternatively, these engaging walls 61 may be substituted for either inflexible or rigid engaging walls which are molded in the female-type connector 37 with other walls or thickened walls. To complete a substitution like this, the first engaging projections 57 and/or the second engaging projections 59 must to be flexible so that the second engaging projections 59 can easily pass downwards through the first engaging projections 57.

In connection with the above, the holding means 63 is not limited to the first engaging projections 57 and second engaging projections 59, and other alternatives of the holding means 63 may also be made within the scope of the present invention.

What is claimed is:

1. A connector comprising:

a female-type connector;

a male-type connector being inserted into and fitted in said female-type connector;

a flexible locking arm provided on said male-type connector;

a locking portion provided on the flexible locking arm;

a lock-engaging portion formed in the female-type connector so as to be engaged with the locking portion; and means for holding the locking arm in a bent state without sliding contact between the locking portion and the female-type connector when the male-type connector is separated from the female-type connector during disengagement of the locking portion from the lock-engaging portion, said means including a finger affixed to said female-type connector.

2. A connector according to claim 1, wherein said holding means comprises a first engaging projection provided on the female-type connector and a second engaging projection provided on the flexible locking arm of the male-type connector so that the second engaging projection is engaged with the first engaging projection.

3. A connector according to claim 2, wherein said female-type connector is provided with a top wall having said lock-engaging portion, and a flexible engaging wall which extends from said top wall toward and inside the female-type connector at a substantially right angle to said top wall; and wherein the first engaging projection is provided on said engaging wall.

4. A connector according to claim 3, wherein the second engaging projection is provided on a side of the flexible locking arm so as to confront said engaging wall.

5. A connector comprising:

a female-type connector;

a male-type connector being inserted into and fitted in said female-type connector;

a flexible locking arm provided on said male-type connector;

a locking portion provided on the flexible locking arm;

a lock-engaging portion formed in the female-type connector so as to be engaged with the locking portion; and means for holding the locking arm in a bent state so that the locking portion is disengaged from the lock-engaging portion, said holding means including a first engaging projection provided on the female-type connector and a second engaging projection provided on the flexible locking arm of the male-type connector so that the second engaging projection is engaged with the first engaging projection, the female-type connector provided with a top wall having said lock-engaging portion, and a flexible engaging wall which extends from said top wall toward and inside the female-type connector at a substantially right angle to said top wall wherein the first engaging projection is provided on said engaging wall, wherein the first engaging projection has a right-triangle-like cross section so as to have a first face extending substantially perpendicular to the engaging wall and a second face sloping upwards, and wherein the second engaging projection has a right-triangle-like cross-section so as to have a first face extending in a direction in which said first face of the first engaging projection extends and a second face sloping downwards, whereby the second engaging projection easily passes the first engaging projection and is then securely engaged therewith.

* * * * *